United States Patent [19]

Dandia

[11] 4,270,302

[45] Jun. 2, 1981

[54] CONSTRUCTION TOY

[76] Inventor: Ghulam M. Dandia, 1324 NE. 127 St., Miami, Fla. 33161

[21] Appl. No.: 966,319

[22] Filed: Dec. 4, 1978

Related U.S. Application Data

[63] Continuation of Ser. No. 763,047, Jan. 27, 1977, abandoned.

[51] Int. Cl.[3] ..... A63H 33/08

[52] U.S. Cl. ..... 46/19

[58] Field of Search ..... 46/16, 17, 19, 21, 23, 46/30, 31, 25; 35/16

[56] References Cited

U.S. PATENT DOCUMENTS

| | | | |
|---|---|---|---|
| 311,793 | 2/1885 | Stranders | 46/19 |
| 2,119,921 | 6/1938 | Levy | 46/25 |
| 2,867,926 | 1/1959 | Cutler | 40/618 |
| 3,168,793 | 2/1965 | Gibson | 46/19 X |
| 3,503,832 | 3/1970 | Umminger | 46/17 UX |
| 3,597,858 | 8/1971 | Ogsbury et al. | 35/16 |

FOREIGN PATENT DOCUMENTS

| | | | |
|---|---|---|---|
| 702106 | 1/1941 | Fed. Rep. of Germany | 46/19 |
| 1294865 | 5/1969 | Fed. Rep. of Germany | 46/25 |
| 1906188 | 8/1970 | Fed. Rep. of Germany | 35/16 |
| 402260 | 11/1933 | United Kingdom | 46/25 |

*Primary Examiner*—F. Barry Shay

*Attorney, Agent, or Firm*—Barry L. Haley

[57] ABSTRACT

A toy utilized for the erection of toy buildings of various designs, the device including a rigid, planar board having a uniform array of apertures of a particular shape disposed on one side, and a plurality of elongated pillars having different cross-sectional shapes, each of which will fit within any of said board apertures. The pillars include one or more grooved longitudinal sides which interlockably receive the side edge of one or more panels, the pillars and panels providing for the wall structure of the building. The device includes flanged panels for providing different types of roofs and pegged stairs which allow for regular or spiral staircases. The particular board or planar surface aperture in conjunction with the various shaped cross-sectional pillars in addition to the other structural elements provide great variability in the particular and ultimate design of the structure allowing for greater creativity in the user.

4 Claims, 18 Drawing Figures

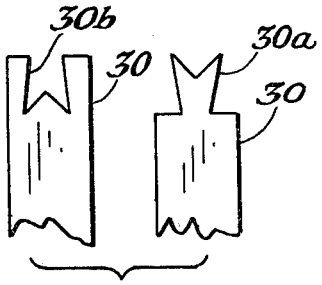
Fig. 4.
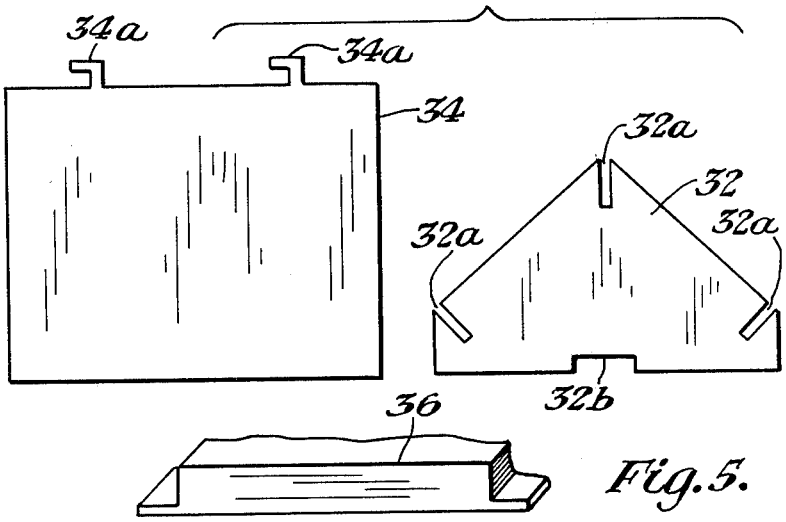
Fig. 5.
Fig. 6.
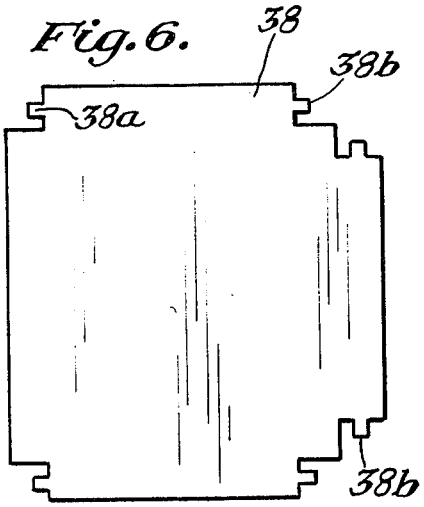
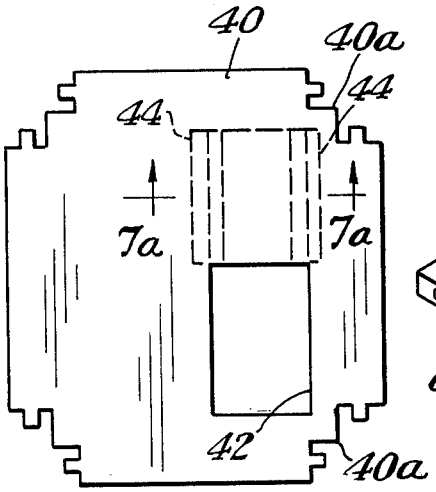
Fig. 7.
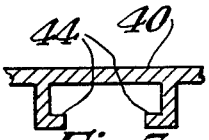
Fig. 7a.
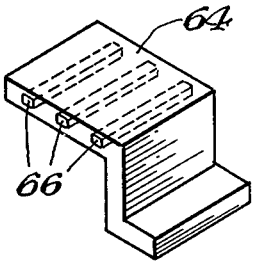
Fig. 7b.
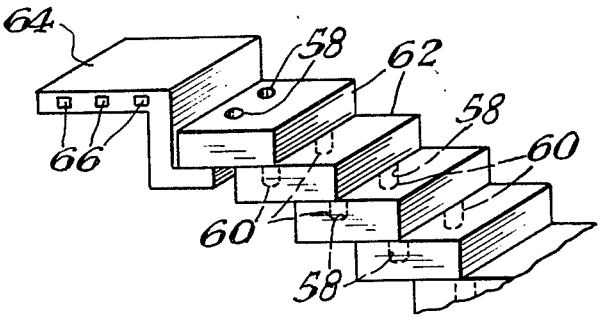
Fig. 7d.
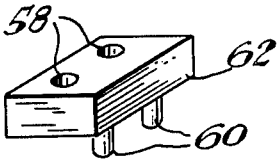
Fig. 7c.

CONSTRUCTION TOY

This is a continuation of application Ser. No. 763,047, filed Jan. 27, 1977, now abandoned.

BACKGROUND OF THE INVENTION

This invention relates generally to a toy which includes a plurality of elements which may be joined together to form toy structures such as a building or the like, and specifically to a toy construction set which allows for great variability and yet rigid structural achievement in the overall design of the building. The device further includes the utilization of different roofs and inclusion of different types of stairwells and stairs for multi-storied buildings.

Many toy construction sets for the simulated construction of buildings and the like have been shown in the prior art. One of the great drawbacks in the prior art construction toys is that because of the particular members employed, the building designs, both interior and exterior, are severely limited in terms of creativity of ultimate construction. Thus, with the prior art devices, a child has been unable to create a realistic simulation of a building while at the same time giving the child creative leeway in the particular shaped ultimate design. For example, many of the devices in the prior art merely show pegs with a single limiting connector that provides for some type of skeleton construction in the building. Further, complete construction for realism such as showing windows, stairwells, and other features normally found in a multi-storied building have not been provided.

The instant invention overcomes the problems of the prior art by providing a unique construction toy which utilizes a rigid, planar mounting board which has a plurality of apertures disposed in a particular array about the board, the apertures being in the shape of a rectangular cross that is capable of receiving four different cross-sectionally shaped pillars, any one of which can interlock within any aperture on the board. This allows for the erection of panels in any one of four directions about a pillar providing extreme versatility in arranging the interior and exterior wall panels of the building (including multi-storied buildings). Further the various pillar cross-sectional shapes allow for design variations in the floor and roof structures, the floors including different stair construction.

BRIEF DESCRIPTION OF THE INVENTION

A toy for the erection of simulated model buildings having one or more floors, the toy device including a plurality of interior and exterior interchangeable and mountable wall panels, a plurality of interlockable floor and roof panels, a plurality of pillars, said pillars having different cross-sectional shapes and grooves disposed along their longitudinal edges to accommodate various structural relationships for mounting said panels.

A rigid, planar board is utilized as the base supporting element of the building to be constructed, the board surface having an array of holes or apertures which are in the form or shape of a rectangular cross, or in effect, a pair of perpendicularly oriented, transposed rectangles, superimposed on each other which forms each aperture. Each aperture in the planar board is the same and are spaced apart depending upon the panel sizes to be employed. The board apertures can be in a perpendicular array or may be spaced randomly about the board.

Each pillar is interlocked at one end into a board aperture and is used as a rigid vertical supporting member for supporting the wall panels (interior and exterior), floors and roof panels of the building. A plurality of pillars is provided, in groups having different cross-sectional shapes, each of which shape, however, fits firmly within any board aperture. In one group, an L-shaped pillar is provided which fits in the adjacent rectangular areas of a board aperture, with longitudinal end edge grooves provided along the surface edges of the elongated L-shaped pillar for perpendicularly connecting together wall panels. A second group of pillars have a T-shaped cross-section allowing for the interconnection of three panels in a perpendicular disposition, with the T-shaped pillar likewise firmly fitting within any board aperture. A third group of pillars includes cross-shaped cross sectional pillars themselves. This allows the interconnection of four different wall panels perpendicularly with a single pillar. By providing groups of pillars of different cross-sectional shapes, each of which firmly interlocks within any board aperture, great variation in design construction of a particular floor plan is provided including both the exterior and interior wall structure.

The wall panels may be made of a rigid plastic or wood material and are sized in height to be smaller than the length of a pillar and in width to be substantially that necessary to connect adjacent or different spaced pillars such that the panels may have a particular minimum width equivalent to the width or distance between the adjacent board apertures and multiples of these widths such that an entire panel could be disposed between extreme apertures and the pillars disposed therein. With a plurality of panels having multiple widths, a large number of variations in pillar and panel arrangement are possible.

The instant invention includes and provides for simulated stairs which may be utilized for multi-storied buildings, the stairs being either of a regular form or a spiral staircase type. The upper level floor panels include rectangularly-shaped apertures for receiving the stair case end. The steps for the regular staircase include a plurality of miniaturized steps which are tiered one on top of the other, between adjacent floors and received into the above floor platform aperture. In the spiral staircase array, a plurality of steps which are essentially pie-shaped peg segments having female and male fastening ends are stacked one upon the other, with the pie-shaped stairs being disposed spirally such that the stairwell will have a single, center support connected between the floors. In essence the fasteners connect a plurality of pegs vertically with the pie shaped steps disposed in a spiral fashion.

The device further includes variations in the roof construction, the invention including an A-frame type of roof having slotted, triangular side support panels and cross support bars and interlocking roof panels for both sides of the A-frame. In another embodiment the upper floors can also be utilized as a flat roof, the floor panels being coupled to the pillars.

It is an object of this invention to provide an improved toy which allows for the construction of model buildings that has large variability in the particular aesthetic shapes and construction designs.

It is another object of this invention to provide a toy construction device which can be utilized for building and erecting multiple level buildings in a variety of shapes and which includes realistic simulation of both interior and exterior walls.

And yet still another object of this invention is to provide a construction toy which allows for the simulation and realistic construction of buildings which includes stairs, and various roof forms.

But yet still another object of this invention is to provide an improved construction toy having a plurality of different supporting pillars which may be utilized in combination with panels having multiple widths to allow for extreme variations in the pillar array over the supporting board surface.

In accordance with these and other objects which will be apparent hereinafter, the instant invention will now be described with particular reference to the accompanying drawings.

BRIEF DESCRIPTION OF THE DRAWINGS

FIG. 4 shows a side elevational view of fragmentary portions of pillar ends utilized in the instant invention.

FIG. 5 shows a partial plan view of the construction elements utilized in the A-frame roof, with element 36 in perspective.

FIG. 6 shows a top plan view of the flat roof utilized in one embodiment of the instant invention.

FIG. 7 is a top plan view of an upper floor having a stair aperture.

FIG. 7*a* shows a side elevational fragmentary cross-sectional view of the upper floor in FIG. 7 showing stair support receiving flanges.

FIG. 7*b* shows a perspective view of a stair support.

FIG. 7*c* shows a perspective view of a step utilized in one embodiment of the invention.

FIG. 7*d* shows a perspective fragmentary view of a stairway utilized in one embodiment of the invention.

PREFERRED EMBODIMENT OF THE INVENTION

Figure 1:
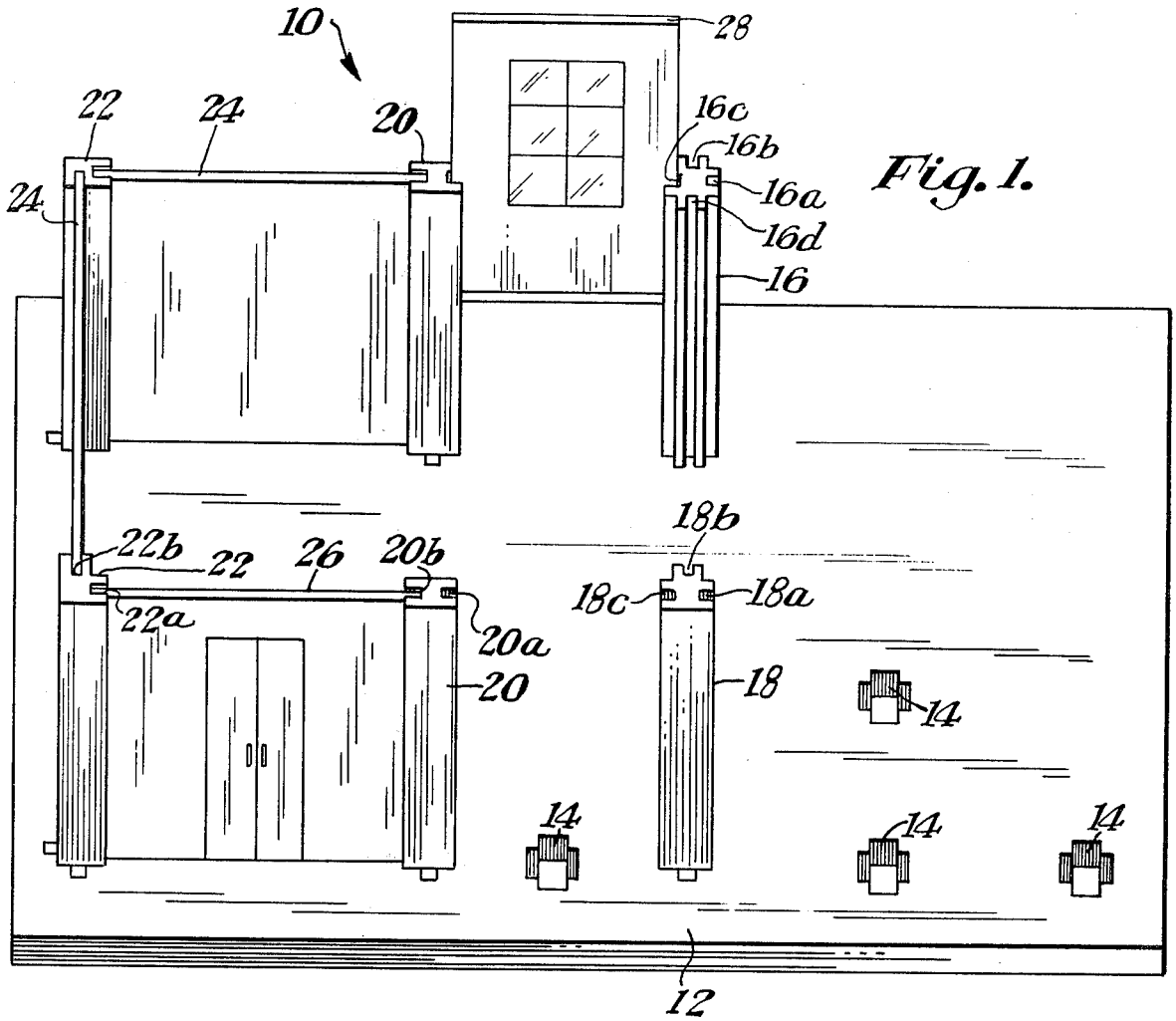
FIG. 1 is a perspective view showing the instant invention and a partial construction of the bottom floor of a building.

Referring now to the drawings, and specifically to FIG. 1, a partially constructed building is shown comprising part of the instant invention 10 which includes a rigid, planar board 12 having an array of apertures 14 which are shaped like a rectangular cross. In essence, the shape of each aperture 14 is as if two rectangular disposed perpendicularly relative to their longitudinal axis are superimposed and laid on top of each other. Each aperture 14 receives a particular pillar which is utilized for the support of wall and upper floor panels. The pillars can be distinguished from each other by the particular shape of the pillar lateral cross-section. In a first group, a pillar 15 is substantially in the shape of the rectangular cross but includes edge grooves 16*a*, 16*b*, 16*c*, and 16*d* which allows four panels to be engaged in the grooves about the pillar 16. Note that the pillar, however and the cross-sectional shape allows it to firmly fit into any one of the apertures 14. In a second group, "T"-shaped pillar 18 has three grooved portions 18*a*, 18*b* and 18*c*. Pillar 18 may be utilized as an exterior pillar while still allowing for support of an interior wall and adjacent side panels. Note, however, that the lateral cross-sectional shape of pillar 18 still allows it to fit firmly within any one of the apertures 14 due to its T-shaped construction. In still another group, pillar 20 is substantially rectangular in shape having oppositely disposed grooves 20*a* and 20*b*, the pillar 20 however being still firmly fitted within the aperture 14. Pillars 20 may be utilized for either interior or exterior panel support structure. In the final group pillar 22 is shown which is L-shaped having grooves 22*a* and 22*b* for receiving wall panels. These may be utilized for corner construction (for exterior or for inner wall panel support).

Wall panels of varying lengths may be utilized (such as solid panel 24) determined as a function of pillar aperture spacing such that a single panel could serve as the exterior wall for the whole side of a building. Also window sections such a panel 28 may be included and door panel such as panel 26 which allow for variations in the overall design of each floor plan. The pillars may be varied as to aperture positioning to provide for particular interior room lay-out and variations in the wall interlocking as far as the perimeter shape of structure is concerned also.

Figure 2:
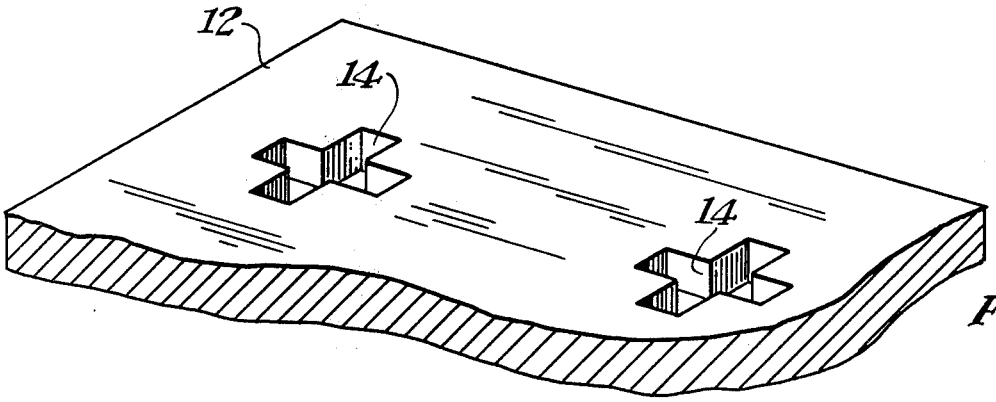
FIG. 2 shows a perspective view of a fragmentary portion of the board utilized in the instant invention.

FIG. 2 shows a portion of the board 12 which is a rigid, planar surface and may be constructed of wood or plastic and the like having adjacent apertures 14 which are rectangular crosses. The depth of the aperture is such to receive the end portion of a pillar to firmly support it to the board itself.

Figure 3A:
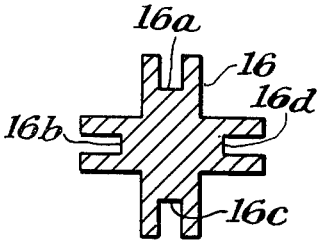
FIGS. 3*a*, 3*b*, 3*c* and 3*d* show a plurality of different pillars from a top cross-sectional view.
Figure 3B:
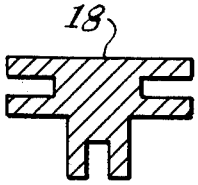
Figure 3C:
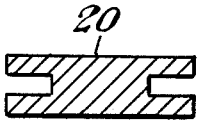
Figure 3D:
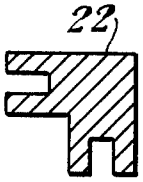

FIGS. 3*a*, 3*b*, 3*c*, and 3*b* show the different groupings of the cross-sectional shape of the pillars. In FIGS. 3*a* a cross shaped pillar 16 is shown having grooves 16*a*, 16*b*, 16*c* and 16*c* disposed around the sides of the pillar. This particular pillar firmly fits in aperture 14 (FIG. 2) and yet allows four panels to be connected to the pillar which would essentially be used with the interior wall construction and room construction.

FIG. 3*b* shows a T-shaped pillar which likewise fits firmly within the board aperture 14 and allows three panels to be attached to the pillar by the disposition of the grooves.

FIG. 3*c* shows a rectangularly shaped pillar having two sides with grooves disposed on opposite sides which still fits firmly within the aperture 14 of the board 12. The final grouping with the L-shaped pillars 22 have a pair of grooves which may be used for the corner of the interior or exterior structure for joining the panels together.

FIG. 4 shows a portion of a pillar 30 which has a fistail end tab 30*a* which may be connected to the pillar above a stacked array. Likewise, at the opposite end of the pillar there is a fishtail groove 30*b* which receives the fishtail tab 30*a* when stacking the pillars. Note however that a pillar may still be disposed within an aperture 14 in board 12 without interfering with the support of the pillar or its fit within the aperture. The fishtail tab 30*a* allows the pillars to be stacked vertically for a firm connection. The pillars also interlock with the floor and roof panels 38 (FIG. 6) in the pillar side grooves, and are longer in height than the wall panels to accommodate the thickness of the floor or roof.

FIG. 5 shows A-frame roof elements which includes the A-frame side panels 32, a supporting beam 36 the ends of which fit in grooves 32*a* for supporting the upper structure and a roof cover panel 34 having tabs 34*a* which interlock into tabs on an identical panel (not shown), both resting on the upper edges of side panels 32. Panel groove 32*b* rests on a pillar end and in pillar grooves.

In an alternate embodiment FIG. 6 shows a flat roof or upper floor 38 having tab sections 38*a*, and tabs 38*b* which may be used with the L-shaped pillars for securing the roof at the corners or with the tabs 38*a* such as single adjoining rectangular pillars for joining to an adjacent roof or floor.

FIGS. 7 through 7*d* show a floor 40 having corner tabs 40*a* which is shaped to receive the L-shaped pillars which allows the second or multiple floors to be supported. Floor 40 also includes an aperture 42 which is positioned next to the upper end of a stairway formed by steps 62 and upper stair support 64. Support flanges 44 form a slot for receiving the upper stair support 64 which has elongated support members (not shown) in channels 66, the ends of which fit into flanges 44; the top end of the stairs resting upon the upper stair support as shown in FIG. 7*d*. The stairway is comprised of a plurality of rectangularly shaped steps 62 having pegs 60 disposed therein which are stacked one on top of the other, the pegs 60 fitting into apertures 58. The peg apertures 58 are vertically offset in each step 62 from pegs 60 to provide proper horizontal spacing in the stacked tier.

Figure 8:
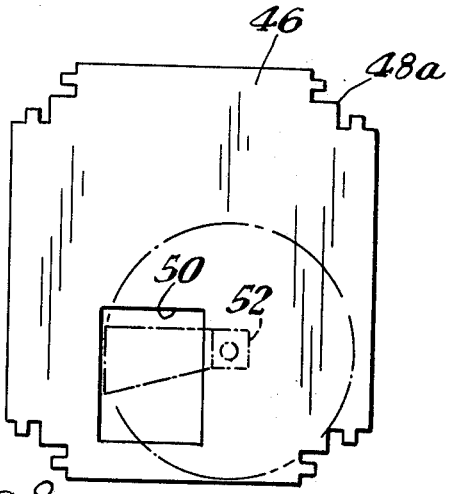
FIG. 8 is a top plan of an upper floor showing a spiral stairway (dotted) beneath.
Figure 8A:
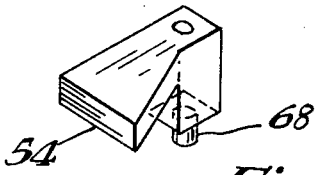
FIG. 8*a* shows a perspective view of a single step utilized in the spiral stairway.
Figure 8B:
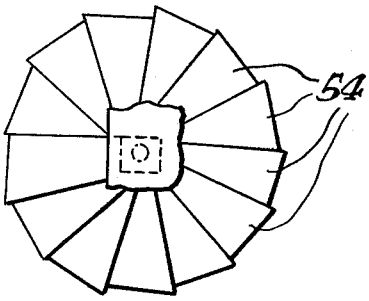
FIG. 8*b* shows a top plan view of a spiral stairway utilized with the instant invention.
Figure 8C:
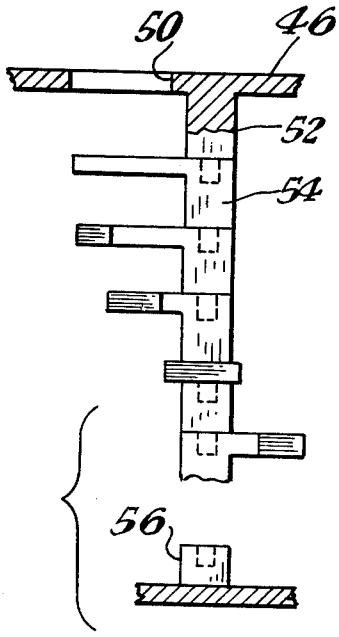
FIG. 8*c* shows a side elevational view of a spiral stairway utilized with the instant invention.

FIGS. 8 through 8*d* show a floor 46 with the corner connectors 48*a* and aperture 50 again permitting access from spiral stairs which are stacked on a column represented by 52. The steps 54 are shaped in pie-shaped segments and include bottom pegs 68 and upper apertures for receiving each step above. A plurality of steps 54 are then stacked one upon the other and spread spirally about the center axis 52 to provide a spiral stairway up to the opening 50. The base of the spiral staircase may include a peg 56 having an aperture disposed therein mounted on the floor.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A toy construction set useful for the erection of toy buildings of various designs, the toy comprising:

a first rigid, planar board having an array of apertures disposed on one planar surface of said board;

a plurality of pillars, each of said pillars having a lateral cross-sectional configuration sized to be fitably received into any of said apertures of said array, each of said pillars having at least two longitudinally disposed side grooves therein;

a plurality of wall panels connectable within said pillar longitudinal grooves along said panel sides for forming a wall structure of a building;

an upper floor panel utilized for forming an additional floor in conjunction with said pillars, said upper floor panel having an aperture disposed therein for receiving a stairwell, said upper floor panel having a plurality of tabs disposed around its perimeter, said tabs being receivable within the longitudinal grooves within said pillars for mounting said upper floor panel in a spaced relationship above said planar surface;

a plurality of steps, each of said steps being pie-shaped and including a protruding peg vertically disposed on one side and an aperture on an opposite side aligned with said vertically protruding peg, whereby said steps are mounted together forming a spiral staircase disposable beneath said aperture disposed in said upper floor panel, said spiral staircase being mounted on said planar surface.

2. A toy, as in claim 1, including:

a first roofing panel having a first pair of interlocking connecting tabs disposed along one side;

a second roofing panel having a second pair of interlocking connecting tabs disposed along one side, said first and second panels being engageable along the respective sides with tabs by said first and second pairs of tabs being interlocked; and a pair of roof supporting means connectable to said pillars and said roof panels resting upon said roof supporting means.

3. A toy, as in claim 2, wherein:

each of said pillars has a flanged end portion at one end and a grooved portion at said opposite end, said flanged and grooved portions allowing said pillars to be stacked vertically and end upon end for creating multi-leveled structures.

4. A device, as in claim 1, wherein:

at least one of said pillars has a rectangular-shaped cross-section and is receivable into said apertures in said planar surface, said apertures in said planar surface being in the shape of a cross, at least one of said pillars having a T-shaped cross-section and at least one of said pillars having a cross-shaped cross-section whereby any of the pillars are receivable in said cross-shaped apertures in said planar surface.

* * * * *